United States Patent [19]

MacLean

[11] 4,399,421

[45] Aug. 16, 1983

[54] LOCK-OUT RELAY WITH ADJUSTABLE TRIP COIL

[75] Inventor: Alexander MacLean, Hingham, Mass.

[73] Assignee: Electro Switch Corp., Weymouth, Mass.

[21] Appl. No.: 233,857

[22] Filed: Feb. 12, 1981

[51] Int. Cl.[3] ..... H01H 9/00

[52] U.S. Cl. ..... 335/174; 335/176; 335/273

[58] Field of Search ..... 335/170, 171, 172, 174, 335/176, 255, 258, 260, 267, 273, 270

[56] References Cited

U.S. PATENT DOCUMENTS

| | | | |
|---|---|---|---|
| 1,749,602 | 3/1930 | Peterson | 335/170 |
| 3,091,725 | 5/1963 | Huston | 335/258 X |
| 3,249,823 | 5/1966 | Beardow | 335/258 |
| 3,303,445 | 2/1967 | Flentge | 335/255 |
| 3,505,628 | 4/1970 | Allen | 335/255 |
| 3,649,793 | 3/1972 | MacLean | 335/174 X |

*Primary Examiner*—George Harris

*Attorney, Agent, or Firm*—Wolf, Greenfield & Sacks

[57] ABSTRACT

A tripping solenoid is used in connection with a lockout relay and has an adjusting means for positioning a plunger end with respect to a coil of the solenoid to predetermine threshold voltage, reluctance, and response time to activation of the plunger by a magnetic field of the coil. A spring opposes movement of the plunger in a first direction toward a push rod which is separated from the plunger and mounted coaxially therewith.

7 Claims, 5 Drawing Figures

Fig. 3
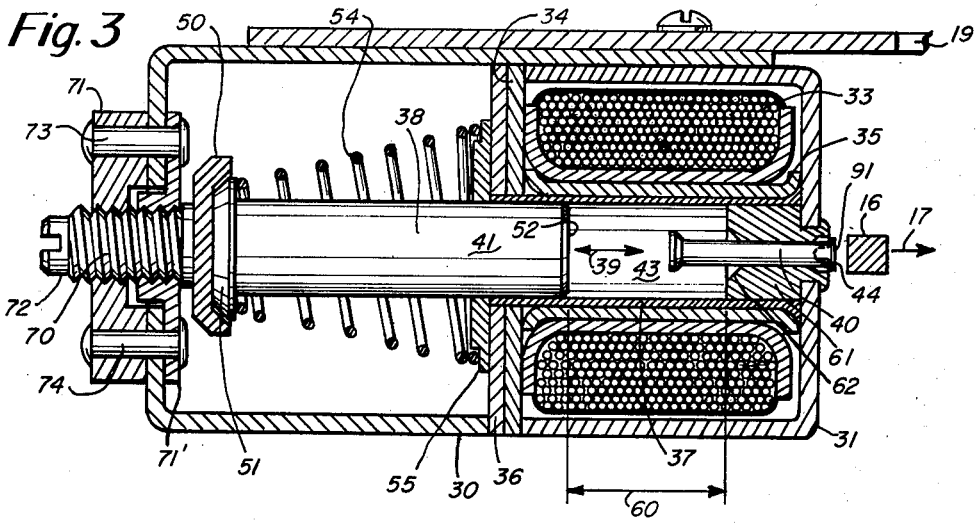
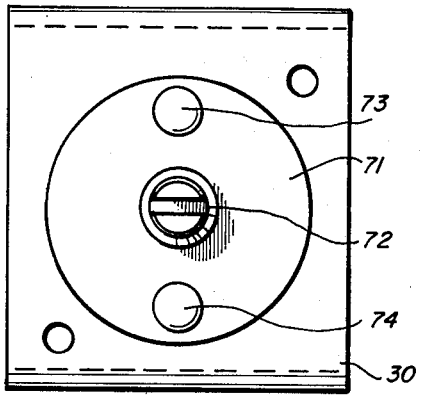
Fig. 4
Fig. 5
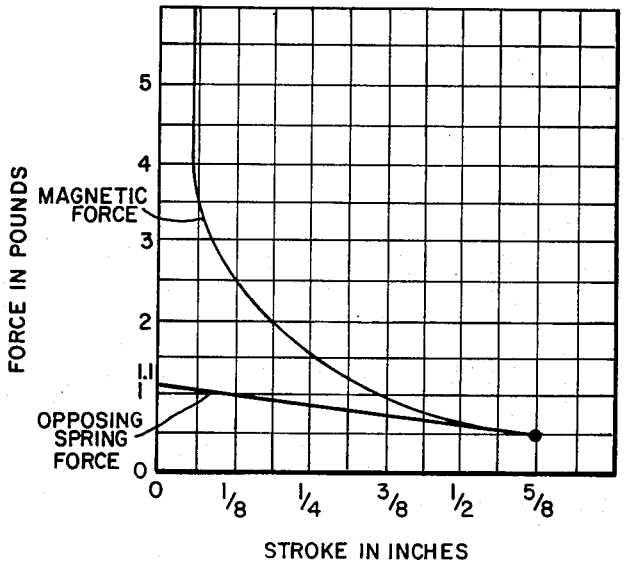

LOCK-OUT RELAY WITH ADJUSTABLE TRIP COIL

BACKGROUND OF THE INVENTION

Lockout relays of various types are used throughout the electrical power industry. Such relays provide remote trip, manual or remote reset operation. They are used for automatically tripping and locking out circuit breakers and operating other devices when a system failure or fault occurs. Lockout relays are often used in conjunction with differential relays to protect transformers, buses and rotating machinery in electrical power systems.

In service, lockout relays are often maintained in the reset position. In the event of trouble such as short circuits, lightning strikes or overloads, they operate by tripping out. When tripping occurs, it is considered undesirable because system integrity is temporarily lost. However, it is the alternate to more severe consequences such as equipment damage due to excessive voltage or current with resulting power failure. Lockout relays are designed to mechanically latch in the reset position; yet, they must trip out with great speed in response to electrical fault signals.

Conventional lockout relay designs utilize a magnetic tripping solenoid for remote operation of a mechanical latch. For a given operating voltage, these solenoids have fewer turns or coils than do other coil designs. The purpose of this is to minimize the inductance thus reducing the time constant ($T=L/R$). This allows the current to rise very quickly in the coil when it is energized. The coils have low DC resistance and require very little energy to operate.

These coil characteristics provide lockout relays with high speed operation, with tripping capable of completion in 16 milliseconds or less. Thus system protection can be initiated very quickly.

A disadvantage to using this type of coil is that they are especially susceptible to false operation from low energy electrical transients that sometimes occur with some frequency in electrical power systems.

The transients are capacitive in nature and their occurrence is considered normal. Occurring at random and lasting only a fraction of a second, they can and have caused lockout relays to trip out causing great disruption. This is considered "nuisance tripping". Power failures can occur due to nuisance tripping.

The industry has determined that it is preferred that lockout relays be designed not to operate or trip at one-half or below the normal operating battery voltage. Thus, a lockout relay having a magnetic tripping solenoid used with a 140 VDC battery should not operate at 70 VDC and below.

The half voltage requirement by itself can be satisfied quite simply. However, if the established operating characteristics of conventional relays are to be maintained, as they must for operative purposes, the half voltage requirement is difficult to meet.

SUMMARY OF THE INVENTION

It is an object of this invention to provide a tripping solenoid for use in connection with actuating a mechanical movement in an electrical device, which solenoid can satisfy established operating requirements and is immune to actuation at nuisance tripping-type voltages.

It is another object of this invention to provide a tripping solenoid in accordance with the preceding object which can be adjusted through a plunger separated from a push rod, to position the plunger with respect to a coil magnetic field, so as to predetermine threshold voltage, reluctance and response time to activation of the plunger by the magnetic field.

Another object of this invention is to provide an adjustable tripping solenoid in accordance with the preceding objects which can trip a lockout relay in less than 16 milliseconds, draw an electric current from a DC supply of low voltage and which does not operate erratically if subjected to mechanical shock and vibration.

Still another object of this invention is to provide a lock-out relay provided with a tripping solenoid in accordance with the preceding objects.

According to the invention, a tripping solenoid for use in connection with actuating a mechanical movement in an electrical device has a coil which determines a magnetic field therein and aids in defining an air gap between a plunger and a stop plug. The plunger has a first end and a second end and is mounted for reciprocal movement along a center line toward and away from the stop plug. A push rod is aligned with the center line of the plunger for reciprocal movement and has an inner end positioned to be actuated by the plunger second end and has an outer end positioned to actuate the mechanical movement. A return spring opposes the movement of the plunger toward the push rod inner end. An adjusting means is provided for positioning the plunger second end with respect to the coil magnetic field to predetermine reluctance and response time to activation of the plunger by the magnetic field.

Preferably the tripping solenoid is used in conjunction with a conventional lockout relay as of the type described in U.S. Pat. No. 3,649,793 issued Mar. 24, 1972, the body of which is incorporated by reference herein.

It is a feature of this invention that the magnetic tripping solenoid has an adjustment means which allows tripping of the lockout relay in less than 16 milliseconds. The solenoid can operate under the same electrical current as conventional tripping solenoids using standard station batteries. The solenoid does not cause operation of the lockout relay irradically even if subjected to mechanical shock and vibration. The solenoid can be adjusted to half voltage characteristics for various ambient temperatures and can maintain those characteristics through operating life.

BRIEF DESCRIPTION OF THE DRAWINGS

The above and other objects, features and advantages of the present invention will be better understood from the following description when read in connection with the accompanying drawings in which:

FIG. 3 is a cross sectional view of the tripping solenoid in accordance with a preferred embodiment of this invention taken through line 3—3 of FIG. 1;

FIG. 4 is a front plan view of the solenoid of FIG. 3; and

FIG. 5 is a graphic view illustrating a feature of the invention.

BRIEF DESCRIPTION OF PREFERRED EMBODIMENTS

Figure 1:
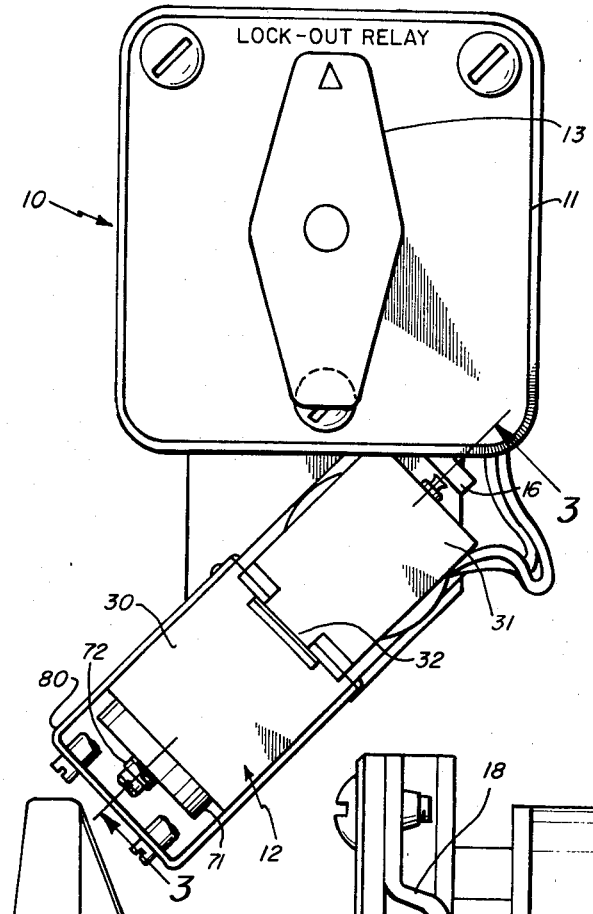
FIG. 1 is a front plan view of a tripping solenoid in accordance with this invention used in a lockout relay.
Figure 2:
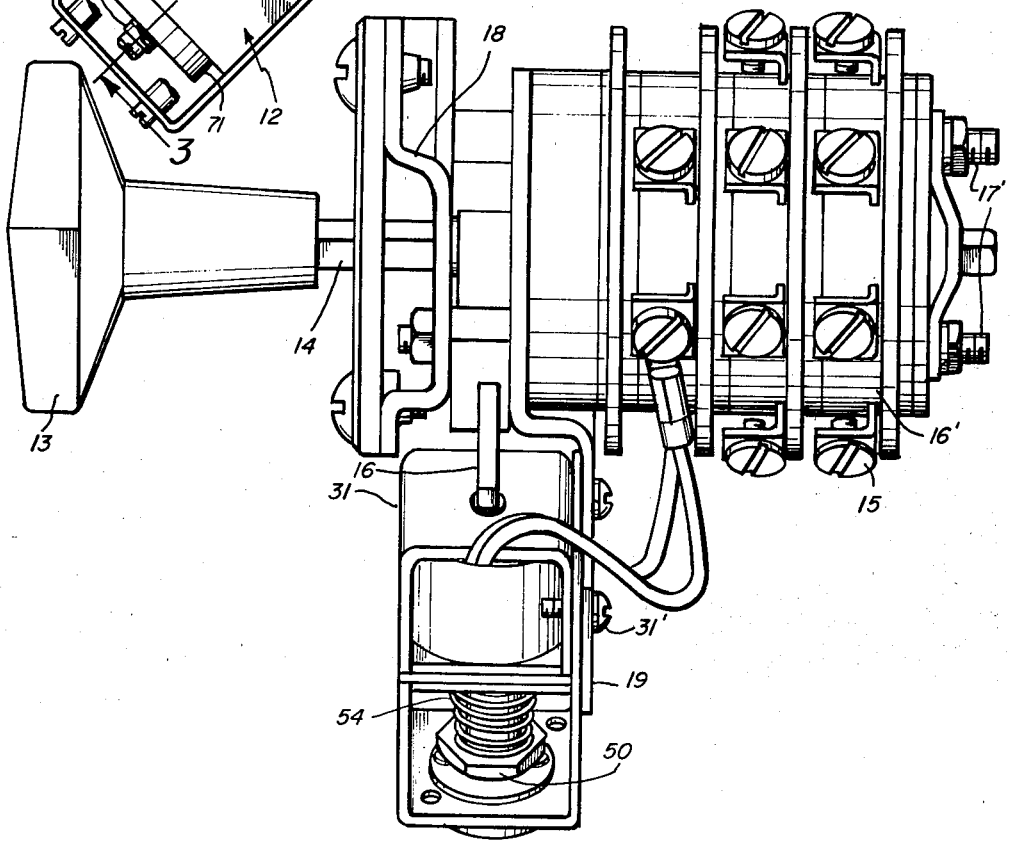
FIG. 2 is a right side view thereof.

With reference now to the drawings, and more particularly FIGS. 1-3, a lockout relay 10 is illustrated generally comprising a lock-out relay assembly 11 having as a component thereof a tripping solenoid assembly 12 which is the subject matter of this invention.

The lockout relay assembly 11 is identical to the one illustrated and described in U.S. Pat. No. 3,649,793 which is incorporated by reference herein. As described in that patent, the lockout relay assembly 11 has a handle 13 which is normally in the reset position with a switch shaft 14 carrying internal contacts for ring contacts such as 15 positioned on a relay insulating body made up of rings such as 16'. Conventional through bolts 17' and support plates and structure 18 are provided for actuation of the contacts carried by the switch shaft 14.

As is known, the switch shaft 14 is in the reset position and can be released by a mechanical latch 16. The latch 16 is resiliently biased into its rest position as shown in FIG. 3 and is actuated by movement to the right as shown by arrow 17 in FIG. 3.

The above-described lockout relay is identical to that described in U.S. Pat. No. 3,649,793 and forms no independent part of the present invention. The tripping solenoid of the present invention is inventive in combination with this lockout relay or others of similar construction used in the electrical industry. In all cases, the solenoid 12 assembly is mounted with respect to the mechanical means such as the latch 16 to actuate the latch when desired. In the embodiment of FIGS. 1 and 2, the solenoid assembly 12 is mounted on a depending flange 19 attached to the body of the lockout relay assembly 11.

The solenoid assembly 12 is best shown in cross section in FIG. 3. It comprises a mounting bracket 30 attached by screws such as 31' to the mounting flange 19 of the lockout relay. The bracket 30 is preferably of resilient metallic material and is attached to a solenoid frame 31 which is a U-shaped member and has side tab attachments shown at 32 in FIG. 1.

The U-shaped member 31 mounts a coil 33 of conventional design in housing members 34 and 35 on a wall 36. An inner cylindrical sleeve 37 slidably mounts a plunger 38 for reciprocal movement in the directions of arrows 39 toward and away from a push rod 40 which itself is reciprocally mounted along a center line 41 of the plunger.

The rod 40 has an inner end 43 and an outer end 44. The plunger 38 has a first end facing a surrounding mating cup 50 which end is preferably frustoconical in cross section as is the inner end of the recessed mating cup 50. The first end acts as a stop for a coaxially mounted return spring 54 which has an end mounted on a circular shoulder washer 55 within which the plunger 38 can reciprocate while constantly urged against the mating cup by the spring.

The position of the mating cup 50 determines the position of the plunger end 52 and also determines the air gap defined at arrow 60 between end 52 and a stop plug 61. The stop plug 61 has an internal frustoconical recess 62 which mates with a corresponding head on the inner end of the rod 40. The plug 61 has an outer end which is recessed to accept a correspondingly expanded frustoconical cross section outer end of the rod 40 when the rod 40 returns to the position shown in FIG. 3.

The position of end 52 of the plunger is determined by the position of the mating cup 50.

The mating cup 50 is fixed to an adjusting screw 70 which is threadably received within a nylon disc 71 having a thread adapted to tightly grip the adjusting screw. A mechanically strong metallic threaded flanged washer 71' is internally threaded and provides a positive axial adjustment for plunger 41. An adjustment slot 72 allows turning of the screw 70 along with its mating cup 50 to move the screw and consequently the plunger in the direction of arrow 39 to the right or left depending upon the turn. The disc 71 acts as a locking disc and has a friction fit with the adjustment screw. This disc 71 and washer 71' are fixed by rivets or other means 73 and 74 to the member 30.

The front face of the member 30 is shown in FIG. 4. The clockwise turning of the adjustment screw moves the end 52 axially to narrow the air gap within the coil.

A dust cover 80 in the form of a U-shaped metallic member covers the solenoid arrangement. The cover acts to prevent dust accumulation. It can have a central cutout to enable adjustment through slot 72 or can cover the assembly in its adjusted position and be imperforate as shown in the embodiment of FIG. 1. In order to adjust the device, it is necessary to remove the dust cover 80. The cover can be spring fit or screwed onto the assembly if desired.

A conventional tripping coil having 1600 turns of magnetic wire at 27 ohms resistance connected to a 140 VDC battery, when used in a conventional lockout relay, in a conventional manner, with the push rod attached to the plunger and having a small air gap such as $\frac{1}{8}$ inch, will trip with as little as 30 VDC applied. This low voltage threshold often results in nuisance tripping. The same 1600 turn, 27 ohm coil when used in this invention can be adjusted to trip only when over 70 VDC volts are applied. Proper positioning of end 52 gives a higher threshold and avoid nuisance tripping.

In order to obtain the desired high threshold operation, a larger air gap than believed practical by the prior art is used in this invention. This large air gap is practical here in part, because a separate, spaced plunger and push rod is used so that the electrical threshold characteristic and mechanical release characteristic of the latch can be separated. In the preferred embodiment which has a threshold of 70 VDC, actuation of the plunger at low voltage is prevented by the spring force since the field strength is below such spring force. Thus when the air gap is large, as $\frac{5}{8}$ inch, the magnetic field is weak and develops only 10% of the solenoid's mechanical output. This can be approximately 0.5 pounds and can easily be balanced by an equal and opposite force from the return spring 54. At half or less of the 140 VDC rating, a plunger movement will not occur, but, a slight increase in flux density in the air gap, will cause a movement as will be apparent from the diagram shown in FIG. 5.

When a half voltage is applied to the solenoid coil 33 with the return spring 54 opposing the plunger stroke, the flux in the air gap can be increased by reducing the air gap. This is done by turning the adjustment screw 70 clockwise. Each quarter turn can be arranged through the pitch of the threads to cause the plunger 38 to move into the solenoid sleeve 0.009 inch. This lowers the magnetic reluctance, allowing the flux level to increase although the applied half voltage remains fixed. When the magnetic pull becomes greater than the return spring force, a plunger stroke occurs. This trips the lockout relay by movement of the latch 16 and establishes the desired operating characteristic in the lockout relay.

The adjustment of the air gap is made easy and convenient by means of the slot 72. The screw is rotated in and out of the adjusting screw holder plate 71' by overcoming substantial opposition due to the friction fit in the nylon locking disc 71. The opposition is functional and acts between the threads to prevent accidental rotation after adjustment. This effectively positions the plunger and sets the desired air gap while preventing ordinary vibration and shock from changing that air gap.

After a half voltage adjustment has been made, operation of the tripping solenoid at 140 volts provides the lockout relay with high speed tripping. For example, the approximate trip time is: 24 milliseconds at 71 VDC and 11 milliseconds at 140 VDC although the stroke 60 is $\frac{5}{8}$ inch. This is due to the magnetic force or pull on the plunger 38. The 0.5 pound return spring 54 is easily overcome, allowing the plunger to be drawn into the solenoid sleeve under the influence of a greatly increasing magnetic field while the opposing spring force increases only slightly. This causes the plunger to accelerate rapidly for the first 87% of its total stroke.

FIG. 5 illustrates the relationship. While the magnetic force greatly increases in non-linear fashion, the opposing spring force increase is essentially linear during the stroke. The area bounded by the two curves and between $\frac{5}{8}$ inch and 5/64 inch represents the energy available for plunger acceleration. At the 5/64 mark (87% of stroke), the plunger meets additional opposition from the engaged latch 16. The distance between the end of the push rod 40 and the latch 16 can be very small as for example 0.046 and a latch movement of 0.025 being required to trip. These distances can vary.

Once the half voltage setting has been made by the adjusting means, the tripping characteristic remains stable. Even though the unit may go through long periods of inactivity as is common or be subjected to accidental shock and vibration and adverse environmental conditions, no change in operative parameters occur.

This is due in part to the fact that the plunger 38, return spring 54, adjusting screw 70 and bracket 30 relationship remains fixed and unchanged in service. The spring firmly holds the plunger in the mating cap ensuring that it is always in the same exact position on the same center line at the instant the coil 33 is energized.

The shoulder washer 55 prevents the return spring from shifting off center line since it is mounted fixedly on the wall 36.

The locking disc by means of frictional bind prevents the adjustment screw from moving while allowing overcoming of friction by a determined force applied through the slot 72.

The bracket is notched to accept the solenoid frame member 31 to prevent any relative motion between the two members after assembly. The dust cover 80 is part of the assembly and restricts access to the screw driver slot when the relay is in service while also preventing dust and foreign bodies from interfering with the plunger stroke.

The push rod 40 undergoes considerable deformation as a result of impact. This occurs at both ends but has no effect on relay tripping since as the head end in the air gap deforms with repeated operation, the countersunk hole 62 accommodates the increased size. The outer tip of the push rod is partially flared to keep it captive in the stop plug and the degree of flaring increases with repeated operation but is predictable and uniform due to the use of a cylindrical hole such as 91 axially extending from the end.

While specific embodiments of this invention have been shown and described, many variations are possible and within the scope of this invention. In all cases, the plunger 38 is separate and apart from the actuating push rod 40. In addition, the air gap as determined along the axial length 60 is prearranged so as to predetermine the reluctance and response time for activation of the plunger. If the plunger and push rod are integral, an increased force is necessary and can slow the response time.

What is claimed is:

1. A lockout relay for use in protecting electrical systems, said lockout relay comprising a tripping solenoid for use in connection with actuating a mechanical movement in said relay, said solenoid comprising, a coil determining a magnetic field therein and aiding in defining an air gap between a plunger and a stop plug, said plunger having a first end and a second end and being mounted for reciprocal movement along a center line toward and away from said stop plug, a push rod aligned with said center line for reciprocal movement and having an inner end positioned to be actuated by said plunger second end and having an outer end positioned to actuate said mechanical movement, a return spring means opposing movement of said plunger toward said push rod inner end, and adjusting means for positioning said plunger second end with respect to said coil magnetic field in accordance with a predetermined threshold voltage, reluctance and response time to activation of said plunger by said magnetic field.

2. A lockout relay in accordance with claim 1 wherein said plunger is actuated to move said push rod to actuate a latch of an electrical device in a time period of 16 milliseconds or less at a predetermined threshold voltage.

3. A lockout relay in accordance with claim 1 and further comprising, said air gap having an axially extending space along an axis of said plunger of about $\frac{5}{8}$ inch.

4. A lockout relay in accordance with claim 3 and further comprising said return spring means surrounding said plunger.

5. A lockout relay in accordance with claim 4 and further comprising, said plunger having an enlarged first end mounting said plunger return spring, said adjusting means comprising a mating cup rotatable about an axis of said plunger to position said plunger for movement against a bias provided by said return spring.

6. A lockout relay in accordance with claim 5 wherein said adjusting means comprises an organic polymeric locking disc, said locking disc being screw threaded, an adjustment screw extending through and frictionally fit within said screw threading so that movement of said adjustment screw actuates corresponding movement of said plunger to provide for adjustment of said tripping solenoid.

7. In a lockout relay having a tripping solenoid capable of activation by a DC voltage source and a mechanical lever actuated by said solenoid to a trip position, a method of adjusting said solenoid to provide for rapid actuation of said solenoid with resistance of actuation below one-half a predetermined voltage requirement for tripping, said method comprising predetermining the position of a solenoid plunger within the solenoid to define an air gap of predetermined size and to predetermine threshold voltage, reluctance and response time to activation of said plunger by a magnetic field of said solenoid, said plunger being provided apart from an actuating push rod aligned therewith for contacting of said mechanical lever.

* * * * *